US006501437B1

(12) United States Patent
Gyorko et al.

(10) Patent No.: US 6,501,437 B1
(45) Date of Patent: Dec. 31, 2002

(54) THREE DIMENSIONAL ANTENNA CONFIGURED OF SHAPED FLEX CIRCUIT ELECTROMAGNETICALLY COUPLED TO TRANSMISSION LINE FEED

(75) Inventors: Eric Andrew Gyorko, Indialantic, FL (US); Richard Edwards Krassel, Oviedo, FL (US)

(73) Assignee: Harris Corporation, Melbourne, FL (US)

( * ) Notice: Subject to any disclaimer, the term of this patent is extended or adjusted under 35 U.S.C. 154(b) by 63 days.

(21) Appl. No.: 09/690,597

(22) Filed: Oct. 17, 2000

(51) Int. Cl.[7] ..... H01Q 1/36; H01Q 1/38
(52) U.S. Cl. ..... 343/895; 343/700 MS
(58) Field of Search ..... 343/895, 700 MS, 343/725, 729, 850

(56) References Cited

U.S. PATENT DOCUMENTS

| | | | | |
|---|---|---|---|---|
| 4,862,184 A | | 8/1989 | Ploussios | 343/745 |
| 5,258,771 A | | 11/1993 | Praba | 343/895 |
| 5,329,287 A | | 7/1994 | Strickland | 343/752 |
| 5,341,149 A | | 8/1994 | Valimaa et al. | 343/895 |
| 5,345,248 A | | 9/1994 | Hwang et al. | 343/895 |
| 5,453,755 A | | 9/1995 | Nakano et al. | 343/872 |
| 5,541,617 A | | 7/1996 | Connolly et al. | 343/895 |
| 5,604,972 A | | 2/1997 | McCarrick | 29/600 |
| 5,874,919 A | | 2/1999 | Rawnik et al. | 343/700 |
| 5,892,480 A | | 4/1999 | Killen | 343/385 |
| 5,914,697 A | | 6/1999 | Seki | 343/895 |
| 5,973,646 A | | 10/1999 | Engblom | 343/702 |
| 5,977,931 A | | 11/1999 | Openlander | 343/895 |
| 5,986,607 A | | 11/1999 | Rudisill | 343/702 |
| 6,137,452 A | * | 10/2000 | Sullivan | 343/873 |
| 6,172,656 B1 | * | 1/2001 | Ohwada et al. | 343/895 |

* cited by examiner

*Primary Examiner*—Don Wong
*Assistant Examiner*—Hoang Nguyen
(74) *Attorney, Agent, or Firm*—Allen, Dyer, Doppelt, Milbrath & Gilchrist, P.A.

(57) ABSTRACT

A low cost, reduced complexity antenna fabrication scheme employs a section of a thin, lightweight flex circuit decal, rather than a wire, as the antenna's radiation element. In order to support and contour the flex circuit decal in a three-dimensional (e.g., helical) shape, the flex circuit is attached to a support core that conforms with the intended three-dimensional shape of the antenna. To reduce the hardware and assembly complexity of using an electro-mechanical connector to interface the antenna radiator and its associated feed, the signal coupling interface for the antenna is effected by electromagnetically coupling of a segment of the flex circuit to a section of transmission line spatially located in close proximity to the antenna.

15 Claims, 2 Drawing Sheets

THREE DIMENSIONAL ANTENNA CONFIGURED OF SHAPED FLEX CIRCUIT ELECTROMAGNETICALLY COUPLED TO TRANSMISSION LINE FEED

CROSS-REFERENCE TO RELATED APPLICATION

The present application relates to subject matter disclosed in co-pending U.S. patent application Ser. No. 09/182,073 (hereinafter referred to as the '073 application), filed Oct. 29, 1998, by Charles W. Kulisan et al, entitled: "Cast Core Fabrication of Helically Wound Antenna," assigned to the assignee of the present application, and the disclosure of which is incorporated herein.

FIELD OF THE INVENTION

The present invention relates in general to the manufacture and assembly of small sized, three dimensional antennas, such as, but not limited to, precision wound helical antennas of the type used for very high frequency phased array antenna applications (e.g., several GHZ to several tens of GHz). The invention is particularly directed to a low cost, reduced complexity antenna fabrication scheme, that forms a three-dimensional antenna of a contoured section of flex circuit. The signal coupling interface for the antenna is effected by means of a section of transmission line feed electromagnetically coupled to the flex circuit.

BACKGROUND OF THE INVENTION

As described in the above-referenced '073 application, recent improvements in circuit manufacturing technologies for small sized components used in high frequency communication systems have been accompanied by the need to reduce the dimensions of both signal processing components and interface circuitry support hardware, as well as their associated radio frequency antenna structures. Such reduced size, high frequency communication systems, including those containing phased array antenna subsystems, often employ a distribution of three-dimensionally shaped antenna elements, such as helical antenna elements wound on low loss foam cores. These types of antenna elements are particularly attractive for such systems, as their radiation characteristics and relatively narrow physical configurations readily lend themselves to implementing physically compact, phased array architectures, that provide for electronically controlled shaping and pointing of the antenna's directivity pattern.

However, as operational frequencies of communication systems have reached into the multi-digit GHz range, achieving dimensional tolerances in large numbers of like components, particularly at low cost, has become a major challenge to system designers and manufacturers. For example, each antenna element of a relatively large numbered element phased array antenna operating at frequency in a range of 15–35 GHz, and including several hundred to a thousand or more antenna elements, for example, may contain on the order of twenty turns, helically wound within a length of only several inches and a diameter of less than a quarter of an inch.

Although conventional fabrication techniques, such as that diagrammatically shown in the perspective view of FIG. 1, which uses a pair of crossed-slot templates 11 and 12 to form a helically configured antenna winding 14, may be sufficient for relatively large sized applications (since relatively small variations in dimensions or shape may not significantly degrade the electrical characteristics of the overall antenna), they are inadequate for replicating large numbers of very small sized elements (multi-GHz applications), where minute parametric variations are reflected as a substantial percentage of the dimensions of each element. In such applications, it is imperative that each antenna element be effectively identically configured to conform with a given specification; otherwise, there is no assurance that the overall antenna architecture will perform as intended. Namely, lack of predictability is effectively fatal to the successful manufacture and deployment of a high numbered multi-element antenna structure, especially one that may have up to a thousand elements, or more.

Advantageously, the invention described in the '073 application successfully overcomes such drawbacks of conventional helical antenna assembly techniques for high frequency designs, through a precision, cast core-based manufacturing process that is capable of producing large numbers of very small helically wound antenna elements, each of which has the same predictably repeatable configuration parameters. A helically wound antenna produced by the cast core-based fabrication scheme of the '073 application is diagrammatically illustrated in the side view of FIG. 2, as comprising an integrated arrangement of a cup-shaped, core-support structure 20, into which a precision molded dielectric core 30 is retained, with a multi-turn wire 40 being wound in a helical groove 42 formed in the outer surface of the dielectric core 30. The cup-shaped core-retaining support structure 20 is also configured to house a baseplate, a tuning circuit for the antenna, as well as a standard, self-mating connector 50 for interconnecting the antenna to an associated transmit-receive module.

The precision molded dielectric core 30 comprises a generally cylindrically shaped, elongated dielectric rod, having a base end 31 affixed to the cup's baseplate 20. A major length portion 32 of the dielectric rod has a constant diameter cylindrical shape adjoining a tapering portion 33, that terminates at a distal end 34 of the core. The helical groove 42 is precision-formed in the outer surface of the core 30, and serves as a support path or track for a length of antenna wire 40 tightly wound in the core's helical groove 42, leaving wire extensions that project from the base end 31 and the distal end 34 of the core 30.

The wire 40 is adhesively secured in the core groove to realize a dielectric core-supported helical winding that is dimensionally stable, and conforms exactly with the precision helical groove 42. The antenna wire-wrapped core is mechanically and electrically attached to the cup-shaped core support structure 20, so that the antenna may be physically mounted to a support member and connected to an associated transmit-receive module. Within this support structure 20, the feed end of the helical antenna wire 40 is physically attached to the center pin of the self-mating connector 50 by means of soldering, for example, so that the connector 50 may provide a direct low loss connection to the transmit-receive module, as described above.

Now, even through the antenna architecture and associated fabrication scheme described and shown in the '073 application provides a significant improvement over conventional small dimensioned antenna production schemes, in terms of repeatability for applications requiring large numbers of very small sized antenna elements, it still requires the use of a direct, hard wired (e.g., solder) connection between the antenna's radiating/sensing wire and feed connector, which implies substantial packaging and cost of assembly.

SUMMARY OF THE INVENTION

In accordance with the present invention, these drawbacks are substantially obviated by a low cost, reduced complexity antenna fabrication scheme, that employs a section of a thin, lightweight flex circuit decal, rather than a wire, as the antenna's radiating element. In order to support and contour the flex circuit decal in its intended three-dimensional shape, the flex circuit is attached to a support core that conforms with the intended (three-dimensional) shape of the antenna. In order to reduce the hardware and assembly complexity of using an electro-mechanical connector to interface the radiating/sensing wire and its associated feed, the signal coupling interface for the antenna is formed by electromagnetically coupling of a section of transmission line to the flex circuit.

For the non-limiting example of forming a helically configured antenna, the core may be generally cylindrically configured so as to conform with the intended geometric shape of the antenna winding. A relatively thin, dielectric-coated ribbon-configured conductor, such as a generally longitudinal strip of polyimide-coated copper conductor or 'flex-circuit', is wound around and adhesively affixed to the outer surface of the core thereby forming a 'decal'-type of helical antenna winding. This enables the flex circuit to be effectively surface-conformal with the core and thereby conform precisely with the intended geometric dimensional parameters of the antenna. To facilitate accurately conforming the flex circuit with a prescribed shape that produces the intended radiation profile of the antenna, placement aides, such as fiducial alignment marks may be provided, or a channel may be patterned in the outer surface of the core by means of a robotic machining, placement and assembly apparatus.

In addition to being wound around and affixed to the core's cylindrical surface the flex circuit extends to a generally planar underside region of a base portion of the core. By wrapping around and attaching this additional length of flex circuit to the underside of the base portion of the core, the winding extends to a location for proximity electromagnetic coupling with a similarly configured section of microstrip feed provided on a dielectric substrate such as the front facesheet of a panel-configured antenna module. The feed-coupling section of the flex circuit is separated from the flex circuit-coupling feed section of the microstrip feed by a thin insulator layer, such as the polyimide coating layer of the feed-coupling section of the flex circuit. This dielectrically isolates the flex circuit from the microstrip feed, yet provides for electromagnetic coupling therebetween. Relatively narrow dimensions of the mutually overlapping and electromagnetically coupled flex circuit and microstrip feed sections provide a connectorless integration of the three-dimensional antenna affixed to the core with signal processing elements that are electrically interfaced with one or more locations of the microstrip separated from the antenna.

DETAILED DESCRIPTION

For purposes of providing an illustrative embodiment, and to contrast the invention with previously proposed compact antenna architectures, the following description will detail the application of the present invention to the manufacture of a relatively small sized helical antenna element, such as may be employed in a multi-element phased array, as a non-limiting example of a three-dimensional antenna that may be manufactured at low cost and reduced assembly complexity using the methodology and components described herein. It should be understood, however, that the antenna configuration with which the invention may be employed is not limited to a helix, but may include a variety of other three-dimensional antenna shapes, that have been conventionally formed of one or more wires and associated electro-mechanical wire-coupling feed connectors, such as those as described above. Similarly, the transmission line feed configuration with which the invention may be employed is not limited to a microstrip line but may include a variety of "printed" transmission line types as recognized by one skilled in the art.

Figure 1:
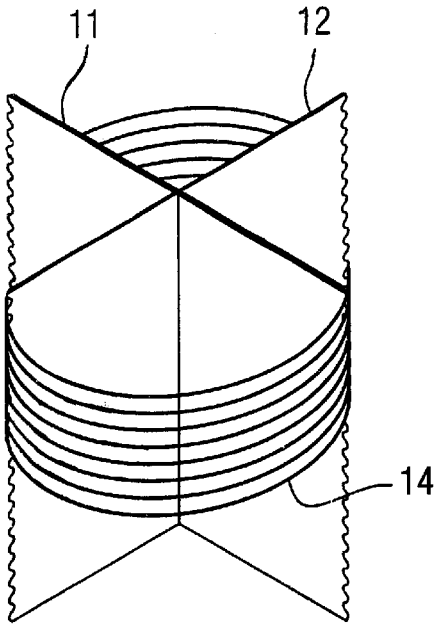
FIG. 1 PRIOR ART
FIG. 1 diagrammatically illustrates the conventional use of a pair of crossed-slot templates for forming a relatively large sized, low frequency helical antenna.
Figure 2:
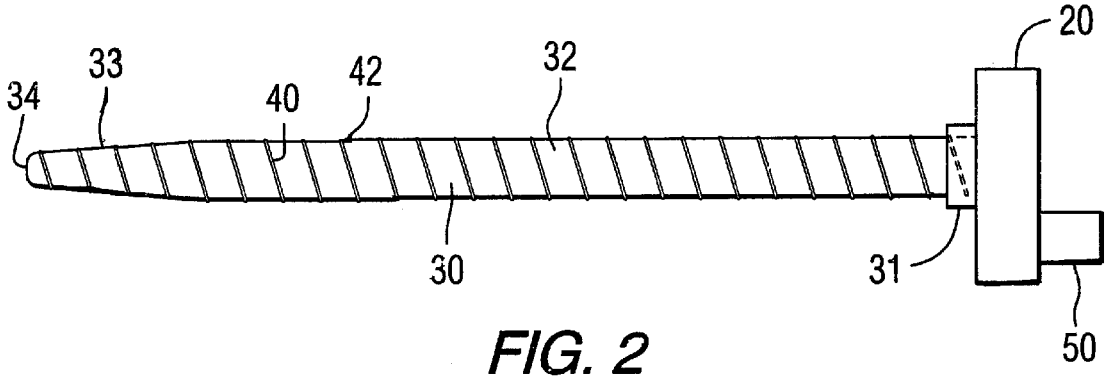
FIG. 2 PRIOR ART
FIG. 2 is a diagrammatic side view of the configuration of a precision, cast core-wound helical antenna produced by the invention disclosed in the '073 application.
Figure 3:
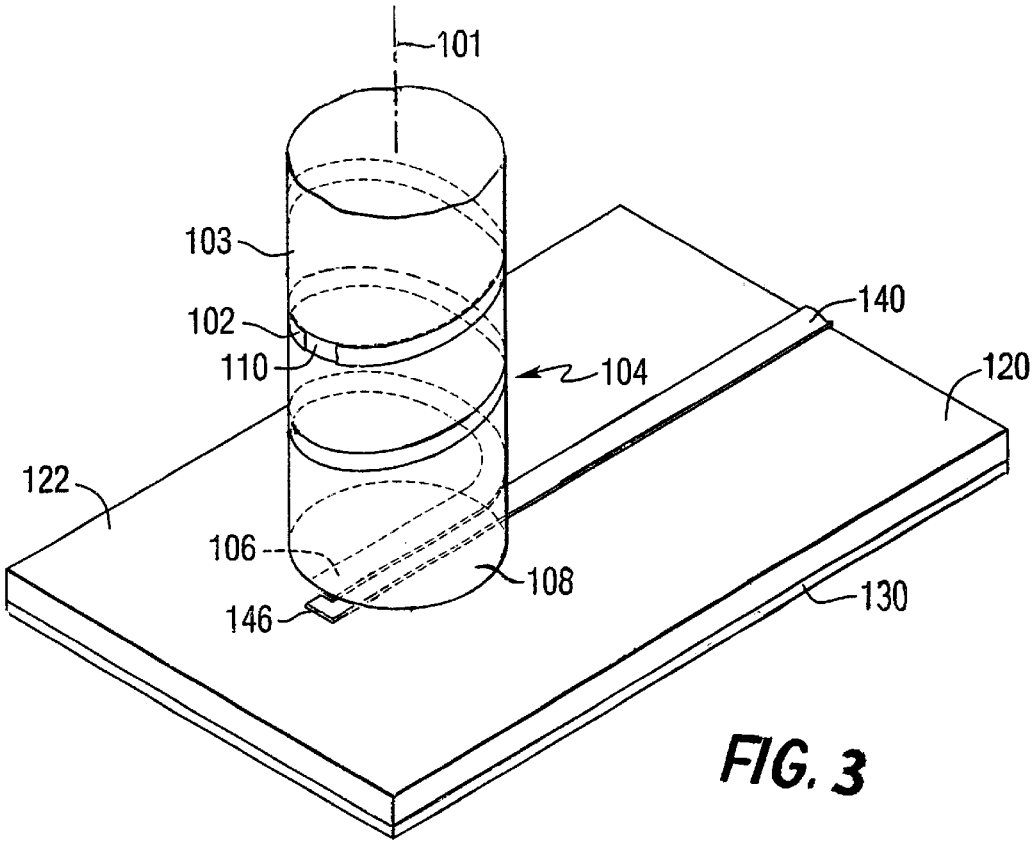
FIG. 3 is a diagrammatic perspective view of a flex circuit-configured antenna having an electromagnetically interfaced microstrip feed in accordance with the present invention.
Figure 4:
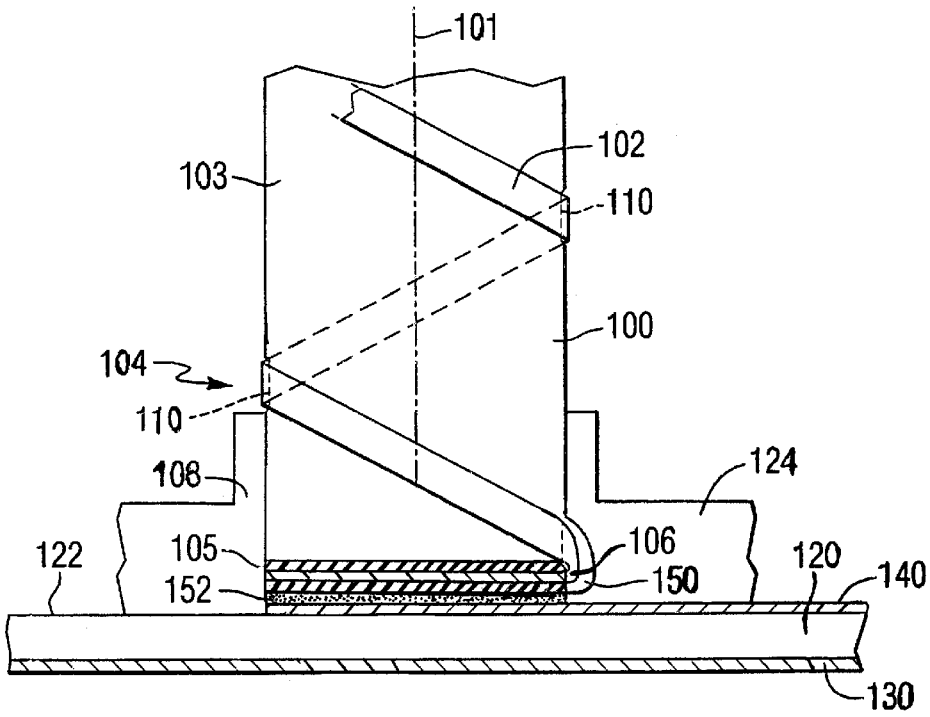
FIG. 4 is a diagrammatic partial side view of the flex circuit-configured antenna of FIG. 3.

An embodiment of an electromagnetically fed, flex circuit-configured helical antenna configured in accordance with the present invention is diagrammatically shown in the perspective view of FIG. 3 and the partial side view of FIG. 4. As illustrated therein, the antenna comprises a generally cylindrically configured support mandrel or core (such as a foam core) 100 that conforms with the geometric shape of the winding to be supported thereon, and having a longitudinal axis 101 coincident with the boresight axis of the antenna. A first segment of a relatively thin, dielectric-coated ribbon-configured conductor 102, such as a generally longitudinal strip of polyimide-coated copper conductor or 'flex-circuit', is wound around and adhesively affixed to the outer surface 103 of the core 100, so as to form a 'decal'-type helical antenna winding 104.

As a non-limiting example, the strip of flex circuit 102 may be affixed to the outer surface 103 of the support core 100 by means of a commercially available adhesive, such as a space-qualifiable adhesive material, for example, a 'peel and stick' two mil thick layer of 966 acrylic pressure-sensitive adhesive transfer tape, manufactured by 3M Corp. Attaching the flex circuit 102 to the core in this manner enables the flex circuit to be effectively surface-conformal with the core 100 and thereby conform precisely with the intended geometric dimensional parameters of the antenna. To facilitate accurately conforming the flex circuit 102 with a prescribed shape (here, a helix) that produces the intended radiation pattern of the antenna, placement aides, such as fiducial alignment marks, or a groove or channel 110, having a depth on the order of one to several mils, for example, may be patterned in the outer surface 103 of the core 100 (as by means of a robotic (e.g., computer numerically controlled (CNC)) machining, placement and assembly apparatus.

In addition to being wound around and affixed to the core's cylindrical surface 103, a second, feed-coupling segment or section 106 of the flex circuit 102 extends beyond the surface 103 to a generally planar underside region 107 of a base portion 108 of the core. By wrapping around and attaching this additional length of flex circuit to the underside of the base portion of the core, the antenna winding (flex circuit 102) is able to extend to a location that facilitates proximity electromagnetic coupling with a similarly configured section of microstrip feed.

Namely, being attached to the underside region 107 of the core enables the flex circuit section 106 to be supportable in a relatively proximate spaced-apart relationship with the generally planar surface 122 of a dielectric support substrate 120, upon which the core 100 is supported, as by way of a core-mounting bracket partially shown at 124. As a non-limiting example, the dielectric substrate 120 may comprise a ten mil thickness of woven-glass Teflon, such as Ultralam, (Teflon is a Trademark of Dupont Corp.; Ultralam is a product of the Rogers Corp). This thin dielectric substrate 120 overlies a ground plane conductive layer 130, such as the facesheet of a panel-configured antenna module supporting the phased array.

Rather than provide a hard wired electro-mechanical feed connection to the antenna winding, which would require an electrical/mechanical bond attachment, such as a solder joint, signal coupling to and from the section 106 of the flex circuit 102 is effected by means of a proximity feed, in particular, an electromagnetic field-coupled segment 146 of generally longitudinal microstrip feed layer 140. For the case of a phased array antenna, the microstrip feed layer 140 may extend from region of microstrip that has been patterned in accordance with a prescribed signal distribution geometry associated with a multi-radiating element sub-array.

As shown in the side view of FIG. 4, this microstrip feed layer 140 is affixed to the generally planar surface 122 of the dielectric support substrate 120, and has its flex circuit-coupling feed section 146 located directly beneath the generally planar underside region 107 of the base of the core 100, and in overlapping alignment with the feed-coupling section 106 of the flex circuit 102. Typically, microstrip line is formed by the etching of a pre-clad microwave laminate material, such as Ultralam. The metal cladding, typically copper, is typically electrodeposited on the core laminate material by the manufacturer.

The feed-coupling section 106 of the flex circuit 102 of the antenna winding is separated from the flex circuit-coupling feed section 146 of the microstrip feed 140 by a thin insulator layer 150, such as the polyimide coating layer of the feed-coupling section 106 of the flex circuit 102, and film adhesive layer 152 so as to dielectrically isolate the flex circuit from the microstrip feed, yet provide for electromagnetic coupling therebetween. It can be seen that the relatively narrow dimensions of the mutually overlapping and electromagnetically coupled flex circuit section 106 and microstrip feed section 146 serve to provide a connectorless integration of the three-dimensional (helical) antenna affixed to the core 100 with signal processing elements that are electrically interfaced with one or more locations of the microstrip separated from the antenna.

As will be appreciated from the foregoing description, the reduced complexity antenna fabrication scheme of the present invention facilitates low cost fabrication of a dimensionally repeatable small sized, three-dimensional antenna by combining the use of a contoured section of lightweight easily manipulated flex circuit with a transmission line feed. The physical configuration of the flex circuit not only allows it to be supported in very close proximity to and thereby be electromagnetically coupled with the transmission line feed, but such electromagnetic coupling allows the antenna/feed assembly to be placed by automated (robotically controlled) assembly machines in close proximity to electronic signal processing components (e.g., microstrip open-circuit line outputs of front-end, low-noise amplifiers of a receive-only phased array antenna system).

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein but intend to cover all such changes and modifications as are obvious to one of ordinary skill in the art.

What is claimed is:

1. An antenna comprising:

a transmission line feed formed on or within an insulating substrate;

a support core having a first portion and a second portion; and a three-dimensionally shaped section of flex circuit comprising a first segment of flex circuit affixed to the first portion of said support core, conforming with the geometry of said antenna and having a generally helical shape, and a second segment of flex circuit affixed to the second portion of said support core, having a generally flat shape, positioned in spaced apart relation with and electromagnetically proximity-coupled to a portion of said transmission line feed.

2. An antenna according to claim 1, wherein an outer surface of said first portion of said support core includes a guide channel for placement of said three-dimensionally shaped section of flex circuit therein so as to conform with said geometry of said antenna.

3. A method of fabricating an antenna comprising the steps of:

(a) providing a transmission line feed configuration printed on the surface of an insulating substrate or within multiple layers of insulating substrates;

(b) three-dimensionally shaping a first segment of said three-dimensionally shaped section of flex circuit so as to conform said section of flex circuit with the geometry of said antenna; and (c) supporting said first segment of flex circuit as three-dimensionally shaped in step (b), relative to said transmission line feed formed on said surface of said insulating substrate, so as to electromagnetically proximity-couple a second segment of said flex circuit with a selected portion of said transmission line feed;

said first segment of said three-dimensionally shaped section of flex circuit having a generally helical shape and said second segment thereof affixed to a second portion of said support core having a generally flat;

step (b) further comprises affixing said first segment of said three-dimensionally shaped section of flex circuit to a first portion of a support core that conforms with said geometry of said antenna, and affixing said second segment thereof to a second portion of said support core;

step (c) further comprises placing said support core relative to said insulating substrate structure, so as to position said second segment of said flex circuit in electromagnetically proximity-coupled relationship with said selected portion of said transmission line feed.

4. A method according to claim 3, wherein step (b) includes affixing said first segment of said three-dimensionally shaped section of flex circuit along a guide channel provided in said first portion of a support core that conforms with said geometry of said antenna.

5. A helical antenna comprising:

a section of microstrip provided on a generally flat surface of dielectric substrate and having an antenna feed segment at a prescribed location of said surface of said substrate;

a generally cylindrically dielectric support core that conforms with an intended geometric shape of said helical antenna and being retained at said prescribed location of said substrate; and a relatively thin, dielectric-coated, ribbon-configured flex circuit conductor, having a first segment thereof wound around and adhesively affixed to an outer surface of said core to form a decal-configured helical antenna winding on said core, and a second segment thereof affixed to a generally planar underside region of a base portion of said core, at a location thereof for proximity electromagnetic coupling with said section of microstrip feed at said prescribed location of said substrate.

6. A helical antenna according to claim 5, wherein an outer surface of said first portion of said support core includes a helical channel for placement of said first segment of flex circuit therein.

7. An antenna comprising:

a transmission line feed formed on an insulating substrate;

a support core having a first portion, a second portion and an outer surface, the second portion being perpendicular to the first portion; and a three-dimensionally shaped flex circuit comprising a first segment of flex circuit affixed to the first portion of said support core for conforming with the outer surface of said support core, and a second segment of flex circuit affixed to the second portion of said support core and insulated from and electromagnetically interfaced to a portion of said transmission line feed.

8. An antenna according to claim 7, wherein said first segment of flex circuit has a generally helical shape.

9. An antenna according to claim 8, wherein said second segment of flex circuit has a generally flat shape.

10. An antenna according to claim 9, further comprising an adhesive layer for insulating and electromagnetically interfacing said second segment of flex circuit with the portion of said transmission line feed.

11. An antenna according to claim 10, further comprising an insulator layer, dielectrically isolating the second segment of flex circuit from the portion of said transmission line feed.

12. An antenna according to claim 11, wherein the first portion of said support core comprises a guide channel for accurately conforming said three-dimensionally shaped flex circuit with the outer shape of said support core.

13. A method of fabricating an antenna comprising:

providing a transmission line feed on the surface of an insulating substrate;

affixing a three-dimensionally shaped first segment of flex circuit to a first portion of a support core, and affixing a second segment of flex circuit to a second portion of the support core, wherein the first portion of the support core is perpendicular to the second portion of the support core; and supporting the first segment of flex circuit relative to the transmission line feed on the surface of the insulating substrate, so as to electromagnetically interface the second segment of flex circuit with a portion of the transmission line feed.

14. A method according to claim 13, wherein the first segment of flex circuit has a generally helical shape and the second segment of flex circuit has a generally flat shape.

15. A method according to claim 14, further comprising providing a guide channel in the first portion of the support core for the first segment of flex circuit.

* * * * *